US008266937B2

(12) United States Patent
Lienau et al.

(10) Patent No.: US 8,266,937 B2
(45) Date of Patent: Sep. 18, 2012

(54) LOCKING DEVICE AND KEY FOR A LOCKING DEVICE

(75) Inventors: Jürgen Lienau, Heiligenhaus (DE); Thomas Wallberg, Wuelfrath (DE)

(73) Assignee: C. Ed. Schulte Gesellschaft MIT Beschränkter Haftung Zylinderschlossfabrik, Velbert (DE)

( * ) Notice: Subject to any disclaimer, the term of this patent is extended or adjusted under 35 U.S.C. 154(b) by 153 days.

(21) Appl. No.: 12/790,281

(22) Filed: May 28, 2010

(65) Prior Publication Data

US 2010/0319422 A1 Dec. 23, 2010

(30) Foreign Application Priority Data

Jun. 18, 2009 (DE) ..... 10 2009 025 993

(51) Int. Cl.
*E05B 19/06* (2006.01)
*E05B 27/00* (2006.01)

(52) U.S. Cl. ..... 70/409; 70/405; 70/493

(58) Field of Classification Search ..... 70/393, 70/402, 405, 409, 493
See application file for complete search history.

(56) References Cited

U.S. PATENT DOCUMENTS

| | | | | |
|---|---|---|---|---|
| 207,599 | A | 9/1878 | Foss | |
| 1,204,410 | A | 11/1916 | Christoph | |
| 1,232,035 | A | 7/1917 | Hurd | |
| 2,294,310 | A | 10/1940 | Larson | |
| 2,735,165 | A | 2/1956 | Soref et al. | |
| 4,325,241 | A * | 4/1982 | Keller | 70/358 |
| 4,343,166 | A * | 8/1982 | Hofmann | 70/358 |
| 4,553,452 | A * | 11/1985 | Keller | 76/110 |
| 4,964,288 | A * | 10/1990 | Braun et al. | 70/406 |
| 5,349,830 | A * | 9/1994 | Keller | 70/358 |
| 5,570,601 | A * | 11/1996 | Field | 70/409 |
| 6,105,404 | A * | 8/2000 | Field et al. | 70/365 |
| 6,257,033 | B1 * | 7/2001 | Ziv-Av | 70/494 |
| 6,912,881 | B2 * | 7/2005 | Kleinhaeni | 70/409 |
| 7,698,921 | B2 * | 4/2010 | Almagor et al. | 70/493 |
| 7,810,364 | B2 * | 10/2010 | Widen | 70/409 |

FOREIGN PATENT DOCUMENTS

| | | | |
|---|---|---|---|
| AT | 408562 | B | 1/2001 |
| DE | 2113008 | A1 | 10/1971 |
| DE | 4112564 | A1 | 10/1992 |
| DE | 9409290 | U1 | 9/1994 |
| DE | 4316439 | A1 | 11/1994 |
| DE | 4422093 | A1 | 1/1996 |
| DE | 29819143 | U1 | 2/2000 |
| DE | 10304152 | A1 | 10/2004 |
| DE | 102004021580 | B3 | 11/2005 |
| DE | 202006005188 | U1 | 6/2006 |
| EP | 0992642 | A1 | 4/2000 |

* cited by examiner

*Primary Examiner* — Christopher Boswell
(74) *Attorney, Agent, or Firm* — Lucas & Mercanti, LLP; Klaus P. Stoffel

(57) ABSTRACT

The invention is concerned with a locking cylinder (1) and a matching key (2), wherein the locking cylinder comprises tumbler pins (6) with a head (7) and a tip. (8). The tip (8) engages in a coding recess (10) of the key (2) and, by withdrawing the key from the locking cylinder, slides along two sliding flanks (2), which follow on one another. The dimensions of the conical surface (9) following on from the rounding of the tip (8) and the sliding flank (12) are made to match one another in such a way that the transitional region (13) between the two sliding flanks is covered by the conical surface in the abutting position.

18 Claims, 12 Drawing Sheets

LOCKING DEVICE AND KEY FOR A LOCKING DEVICE

CROSS REFERENCE TO RELATED APPLICATIONS

This application claims the benefit of German application DE 102009025993.7 filed Jun. 18, 2009 which is incorporated by reference herein.

BACKGROUND OF INVENTION

The invention also relates to a key for a locking device.

DE 298 18 143 U1 describes a safety key and the tumbler pin of an associated locking cylinder. The broad side face of the flat key shank of the safety key has a multiplicity of cup-shaped coding recesses. Each coding recess has a supporting flank, which is formed by the bottom of the cup and on which the blunt end of a tumbler pin beveled at the tip can be supported. The supporting surface merges into a concavely rounded sliding surface. This rounding merges into a more inclined sloping flank. The latter merges into a concavely rounded sliding surface with a smaller slope. The concavely rounded sliding surface runs out in a broad side face of the key shank. This produces a shape of a sliding flank without any points of inflection and with portions inclined to differing degrees with respect to the direction of insertion of the key into the key channel of the locking cylinder.

A coding recess with a sliding flank of a shape without any points of inflection and with portions sloping to differing degrees is also described by DE 20 2006 005 188 U1. Here, the wall of the coding recess is formed by an arcuate portion produced by the use of a circular milling cutter with a constant milling radius.

DE 10 2004 021 580 B3 describes a flat key with coding recesses with straight sliding flanks. The flanks of adjacent coding recesses merge into one another while forming an acute angle. The apex angle of the two sliding flanks forming a coding recess is approximately 106°. The apex angle is preferably greater than 90°, in order to keep down the force component acting in the horizontal direction during the withdrawal of the key from the key channel. The shallower the angle of the sliding flank, the smaller the forces in the horizontal direction that are required to move the tumbler pins in the axial direction. Shallow sliding flanks have the disadvantage, however, that directly adjacent coding recesses can only have a relatively small difference in their depth of incision. The coding of a flat key is achieved by sliding flanks cut to different depths. The sliding flanks may meet at a point of intersection, as is the case for example in DE 10 2004 021 580 B3. The sliding flanks may, however, also merge into a supporting flank, as is the case with DE 298 18 143 U1. When the key is pushed into the key channel of a locking cylinder, a tumbler pin is made to enter an allocated coding recess. The tumbler pins are of different lengths, the depth of insertion of the associated coding recess being adapted to the length of the respective tumbler pin in such a way that, when the key is completely pushed in, the tumbler pins do not protrude beyond the shear line of the locking cylinder into a driver pin hole and driver pins mounted in the driver pin hole do not protrude into the core pin hole.

In order to increase the variety of permutations, the maximum differences in the depths to which adjacent coding recesses are cut must be as great as possible. With shallow sliding flanks, this requires adjacent tumbler pins to be spaced far apart in the direction of extent of the key channel. This would increase the overall length of the locking cylinder, which is undesired. If, for example, the slope of the sliding flanks is increased to 90°, the force component acting in the direction in which the key is withdrawn, that is to say in the direction of extent of the key channel, at the same time becomes greater. This may lead to a tumbler pin jamming within the pin hole.

SUMMARY OF INVENTION

It is an object of the invention to increase the variety of permutations while maintaining an overall length of the locking cylinder that is as short as possible.

The invention relates to a locking device comprising a locking cylinder and a matching key, the locking cylinder having a cylinder core with a key channel for inserting the key and with pin holes opening out into the key channel, in which pin holes tumbler pins are mounted, the pins forming a head with a tip and a conical surface which follows on from the tip, the head engaging in a coding recess of the key and being supported there by the tip on a portion of the wall of the coding recess, the wall forming a first sliding flank, on which the head of the tumbler pin lies in an abutting position before the axial displacement of the tumbler pin in the pin hole that is brought about by withdrawing the key from the key channel and along which it slides in a first phase of movement during the withdrawal of the key, and the wall forming a second sliding flank, which follows on from the first sliding flank in a transitional region, which second sliding flank slopes more steeply than the first sliding flank with respect to the direction of extent of the key and on which the head slides along in a second phase of movement during the withdrawal of the key.

The object is achieved by the invention specified in the claims.

First and foremost, it is proposed that the dimensions of the conical surface following on from the rounding of the tip and of the first sliding flank are made to match one another in such a way that the transitional region is covered by the conical surface in the abutting position. The two sliding flanks, intersecting at a real or imaginary point, on which the head of the tumbler pin slides along in a first phase of movement during the withdrawal of the key from the key channel may have an apex angle which is relatively great, for example is 106°, as in the prior art. The rounded tip of the tumbler pin slides along on this first sliding flank when the tumbler pin is set in motion from a rest position by accelerations. This accelerating flank is followed by a second sliding flank, which is steeper. The two second sliding flanks, respectively associated with a coding recess, may have an apex angle which is much smaller, for example 90°. The shallow first sliding flank merely has the task of overcoming the static friction when the tumbler pin is set in motion. The sliding friction, of a lower value, causes a smaller force component in the direction of withdrawal, so that the relevant sliding flank slope can be greater. The region of the first, less inclined sliding flank is consequently restricted to the region in which the core pin is accelerated. This region may be smaller than the radius or the diameter of the core pin. With the configuration of the two sliding surfaces according to the invention, a "gentle launch" of the core pins is consequently achieved. The transitional region of the two sliding flanks, which can merge one into the other there while forming a point of intersection, that is to say a point of inflection, lies in the region of the conical surface. This covers the transitional region. The sliding flanks are substantially straight. As a result, space is optimally utilized. The cone angle lies in the region of the apex angle of the second sliding flanks and is preferably slightly smaller than this apex angle. The coding recesses may be produced using a side and face-milling cutter. The side and face-milling cutter has a V-shaped disk profile, the two V legs having portions that slope to differing degrees. The coding recesses cut in to different depths with a side and face-milling cutter of this type are consequently of substantially the same configuration. The first sliding flanks always extend over the same portion of extent of the key shank.

In a development of the invention, it is provided that at least one tumbler pin has a conical surface, the cone angle of which is greater than the apex angle of the second sliding flank. This tumbler pin does not lie with its rounded tip against a supporting flank or a first sliding flank. Rather, the head of this tumbler pin lies, against the second sliding flank, with a transitional region between a second conical surface, which has a smaller apex angle, and the conical surface following on from the tip. This is indeed in keeping with greater forces of acceleration. The different cone angles, however, increase protection from picking by lock bumping. The key may be a flat key with a coding recess cut in on the front side, as described by DE 10 2004 021 580 B3. However, the key may also be a flat key with coding recesses milled into the broad side face using an end-milling cutter, as described in principle in DE 298 18 143 U1. In both cases, it is possible for the rounding at the tip of the tumbler pin to be supported on a supporting flank running parallel to the direction of extent of the key shank.

A development of the invention relates to a locking device with a locking cylinder which can be coupled with a locking element by means of a coupling, and to a key relating to the locking cylinder. DE 103 04 152 A1 describes a locking cylinder of this type with an associated key. The key has a tip portion which is flanked by two flank portions and enters the slit of a coupling element in order to couple the cylinder core to the locking element. A locking cylinder with an associated key in which the key tip performs a coupling function is also known from DE 41 12 564 A1. The flank portion forming the key tip is inclined with respect to the direction of insertion of the key shank into the key channel. A portion of this flank that is remote from the key tip forms a sliding slope which acts upon the heads of the tumbler pins when the key is pushed into the key channel, in order to move the tumbler pins into their pin holes in the axial direction.

According to the invention, it is provided that the sliding slope is shallower than the flank portion of the key tip directly following on from it. The angle of the sliding slope and the cone angle of the tumbler pin are made to match one another in such a way that the conical surface is acted upon by the sliding slope over substantially its entire axial length. The sliding slope therefore does not act upon the head of the tumbler pin only in the region of its tip or only in the region of the transitional region of the conical surface to the cylindrical shank portion of the tumbler pin, but more or less over the entire length of the cone. Instead of point contact, there is linear contact. The cone angle and the angle of the sliding slope do not have to match 100%, since a certain tilting of the tumbler pin can be accepted. However, this tilting must not be so much that the tumbler pin becomes misaligned in its pin hole. In addition, this sliding slope may also have steeper or shallower portions. What is important is that, in its acceleration phase, that is to say in the first phase of movement, the tumbler pin is acted upon by a portion of the sliding slope against which the conical surface can come to lie in a linearly abutting manner.

BRIEF DESCRIPTION OF THE DRAWINGS

Exemplary embodiments of the invention are explained below with reference to appended drawings, in which.

DETAILED DESCRIPTION OF THE INVENTION

Figure 1:
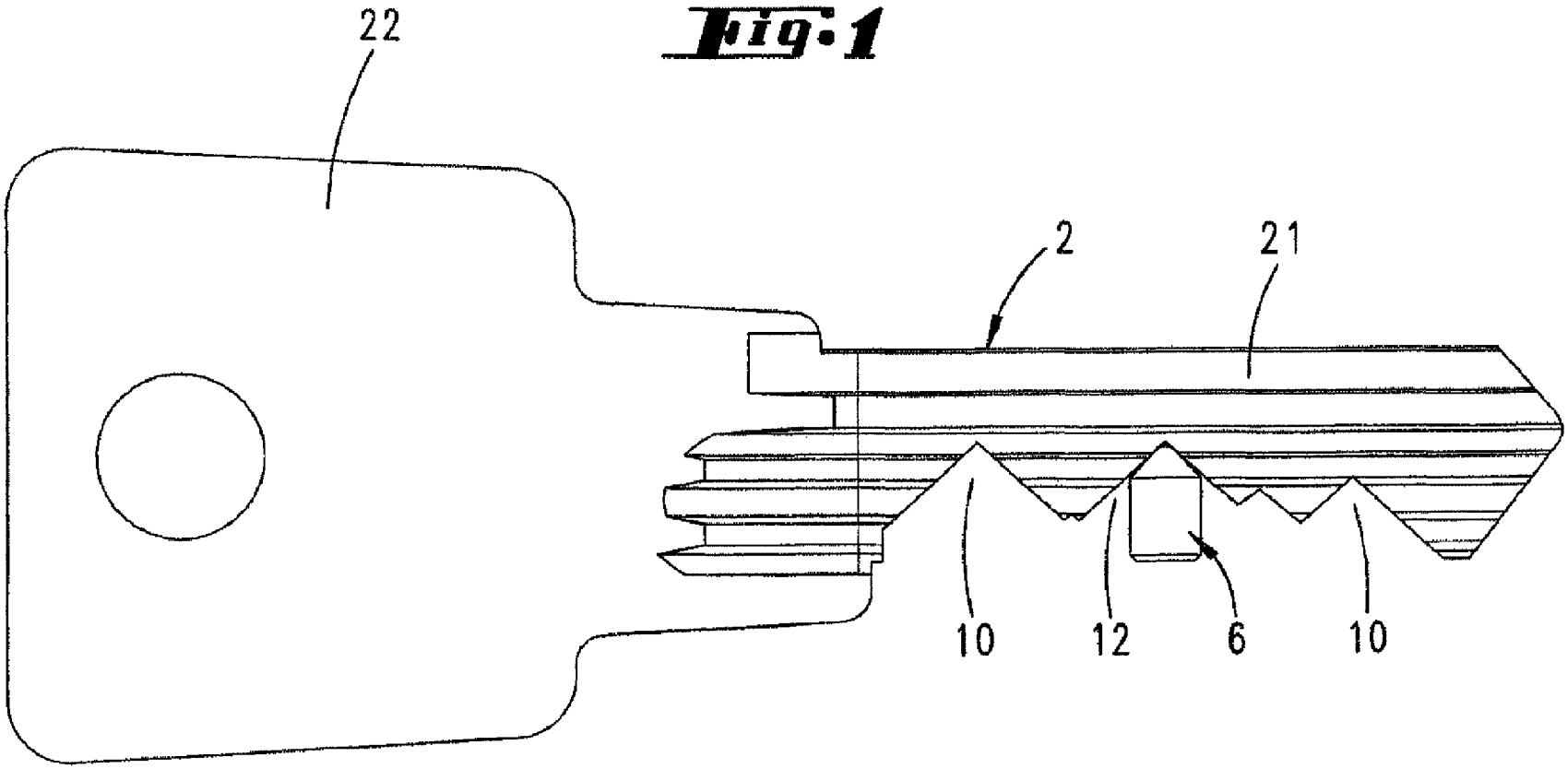
Fig. 1 Prior Art
FIG. 1 shows a key according to the prior art with an indicated tumbler pin.
Figure 2:
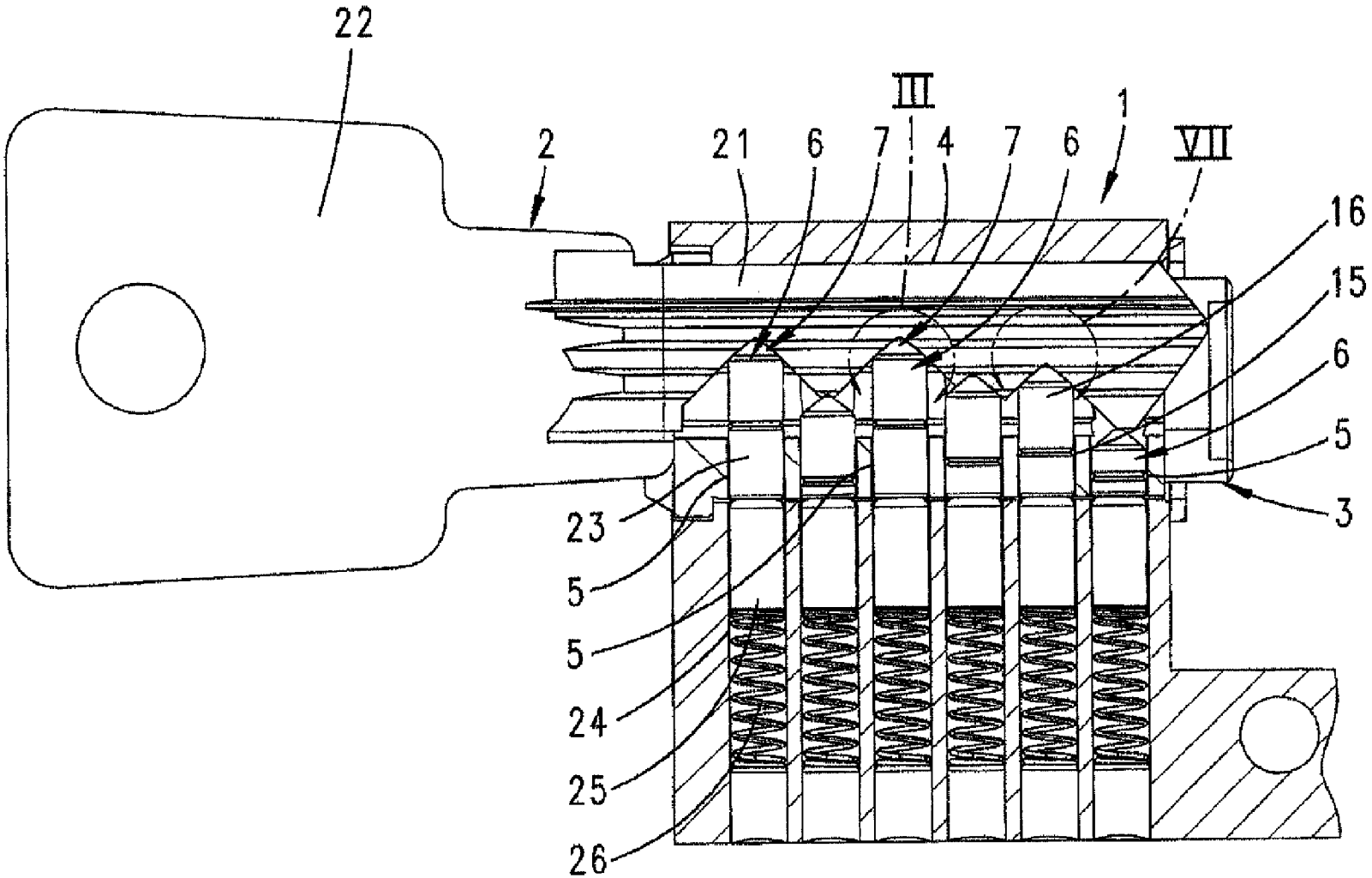
FIG. 2 shows a longitudinal cross-section through half of a double locking cylinder, in which a key according to the invention has been inserted into the key channel of the cylinder core.

The prior-art key 2 represented in FIG. 1 has a key bow 22 and a key shank 21 following on from the key bow 22. The key shank 21 has a broad guiding rib and a multiplicity of profiled ribs. The key channel of the cylinder core of an associated locking cylinder has a corresponding cross-sectional profile. The key shank 21 has a total of six coding recesses 10, each with an associated core pin, the coding recess that is adjacent the tip having a depth of zero. The coding recesses are formed by V-shaped incisions, which merge into one another with sharp edges.

The development according to the invention of the key represented in FIG. 1 that is represented in FIGS. 2 to 7 likewise has V-shaped coding recesses 10. In the apex regions of the coding recesses 10, the rounded tips 8 of the heads 7 of core pins 6 are supported. The core pins 6 are also underlaid by small plates 23 and slidingly mounted in core pin holes 5. When a matching key 2 is inserted, the ends of the core pins 6 opposite from the heads, or in the exemplary embodiment the ends of the small plates 23, are in line with the parting plane between the cylinder core 3 and the hole in the locking cylinder casing 1. This prevents driver pins 25, which are respectively mounted in a hole 24 in the casing, from crossing the parting plane and protruding into the pin hole 5 under the force of a tumbler spring 26. Similarly, the core pins 6, or in the exemplary embodiment the small plates 23, do not protrude into the hole 24 in the casing. The cylinder core 3 can consequently be turned by means of the key. The key tip engages in a coupling (not represented), in order to turn a locking element (not represented) for the purpose of actuating a lock.

The coding recesses 10 have a first pair of sliding flanks 12, which intersect at an apex point 12'. It is important that the first sliding flanks 12 are straight. In the exemplary embodiment, there is a real point of intersection 12'. The first sliding flanks 12 may, however, also intersect at an imaginary point of intersection, if for example they first merge into a supporting flank running parallel to the extent of the key shank. In the exemplary embodiment, the rounded tip 8 of the head 7 of the core pin 6 is supported on the two first sliding flanks 12. In a variant that is not represented, the rounding of the tip 8 may, however, also be supported on a supporting flank.

The reference numeral 13 designates a point of inflection. Here, this is a transitional region in which the first sliding flank 12 merges into a second sliding flank 14, which has a greater slope with respect to the direction of extent of the key shank 21. The transitional region 13 is covered by the conical surface 9 of the head 7.

With respect to the direction of displacement of the core pin 6, the axial spacing of the transitional region 13 from the tip 8 of the core pin 6 which is held in position in the coding recess 10 is less than the axial length of the head 7 that is made up of the axial length of the tip 8 and the axial length of the conical surface. The spacing of the transitional region 13 from the center axis, passing through the tip 8, of the core pin 6 positioned in the coding recess 10 is less than the radius of the cylindrical shank portion of the core pin 6. As a result of this, the extent of the spacing between two opposing transitional regions 13 of a coding recess 10 in which the tip 8 is supported simultaneously on two first sliding flanks 12 is also less than the diameter of the core pin 6.

In the exemplary embodiment, the apex angle $\alpha$ of the two first sliding flanks 12 is approximately 106°. The apex angle of the second sliding flanks 14 is approximately 90°. The cone angle $\gamma$ of the conical surface 9 in the exemplary embodiment is approximately 86°. The cone is configured in such a way that the diameter of its base area, with which the cone portion 9 follows on from the cylindrical shank portion of the core pin 6, is at least four times the diameter of the head of the cone portion 9 that is followed by the rounding of the tip 8. In the exemplary embodiment, the diameter ratio is approximately six. The dimensions are in any case chosen such that the rounding of the tip 8 is supported on the first sliding surface 12 and the transitional region 13 lies in the region of the conical surface 9.

Figure 3:
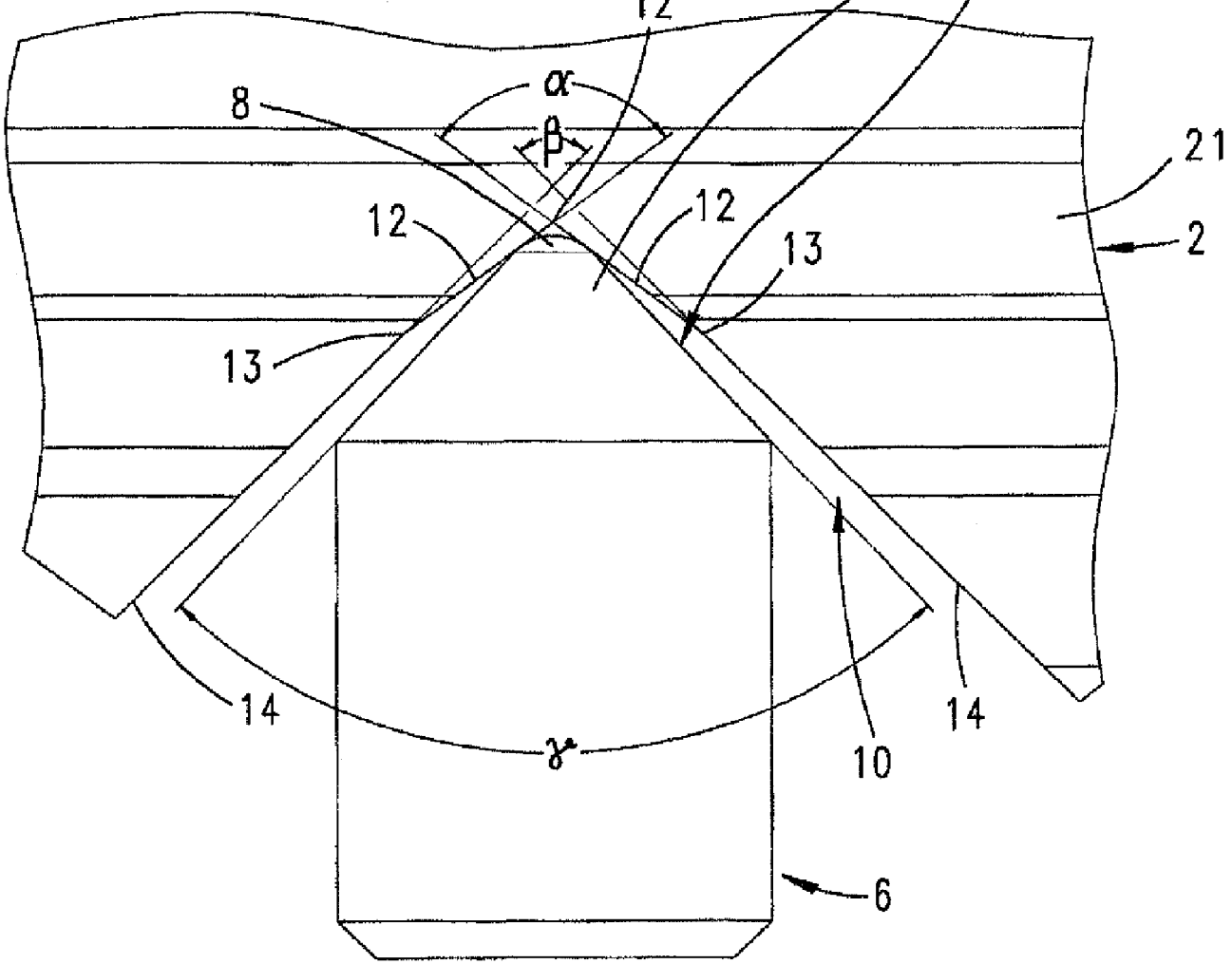
FIG. 3 shows the detail III from FIG. 2 in an enlarged form with the rounded tip of the tumbler pin being supported in the apex region of a coding recess.
Figure 4:
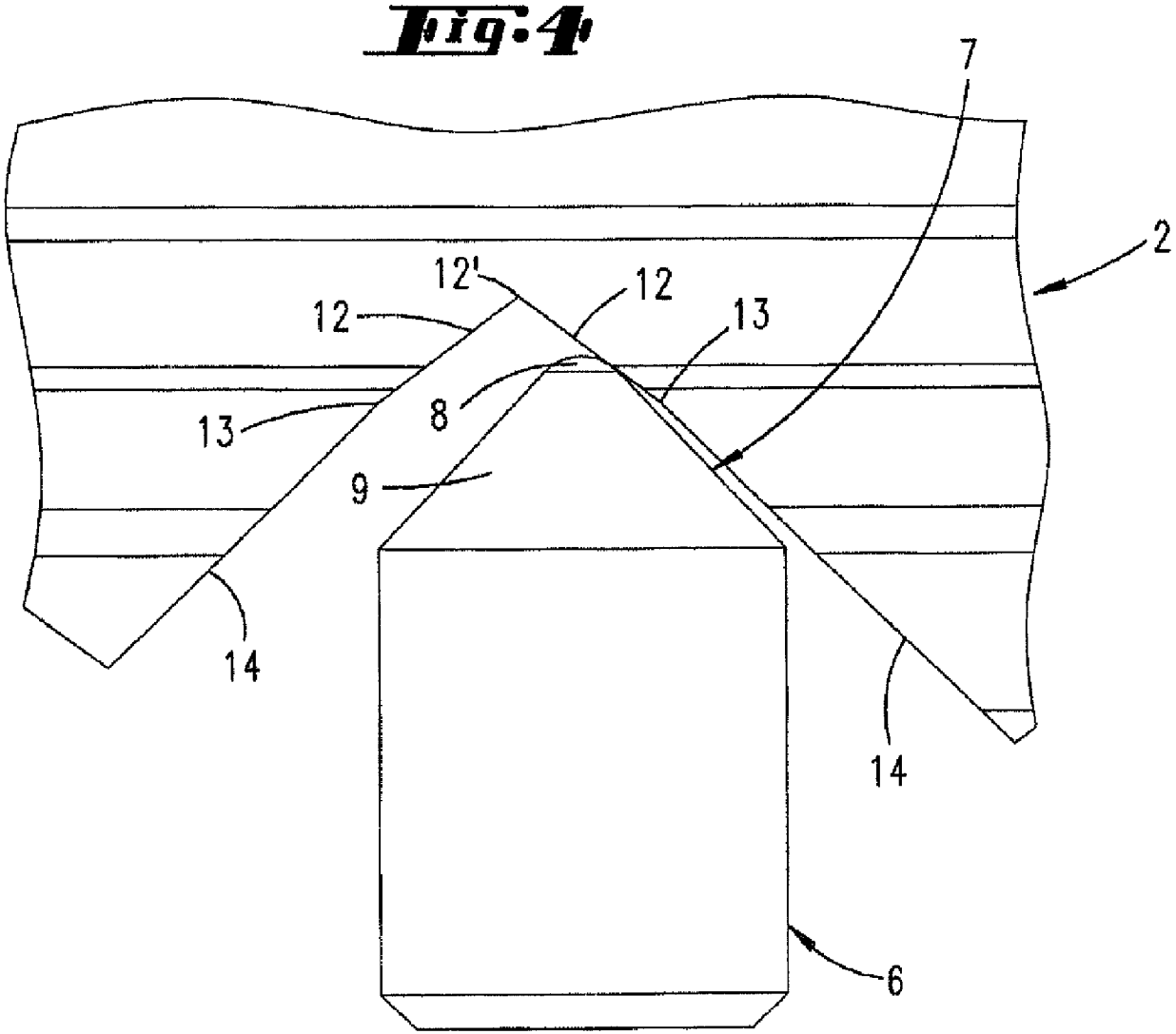
FIG. 4 shows a representation as shown in FIG. 3 in a first phase of movement during the withdrawal of the key from the key channel with the tumbler pin being accelerated by sliding along on the first sliding flank.
Figure 5:
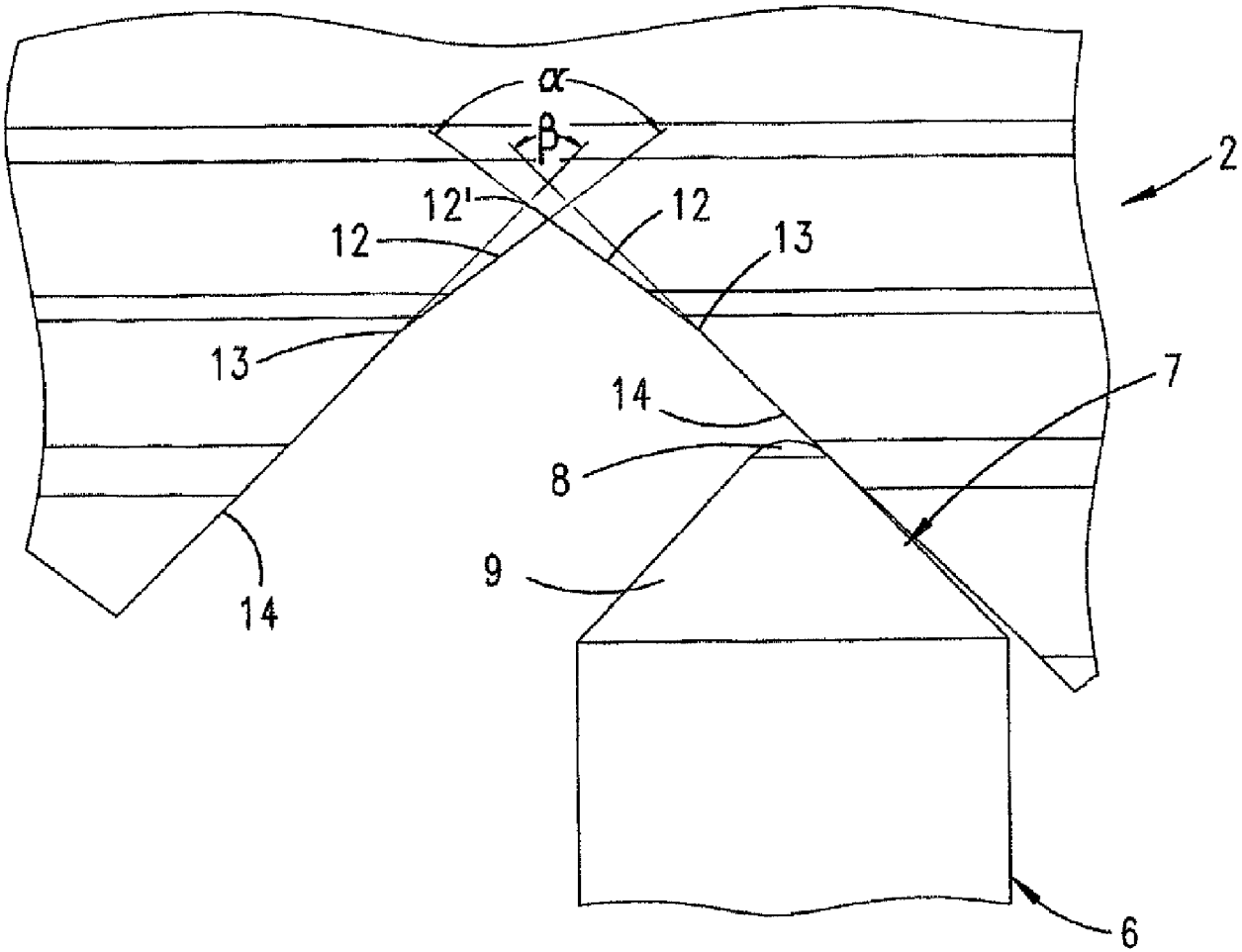
FIG. 5 shows a representation of what follows with the tumbler pin sliding along on the more steeply inclined second sliding surface.

The operating principle is as follows: if the key 2 is withdrawn from the key channel to the left from the position of rest that is represented in FIG. 3, the tip 8 first slides along on the shallow first sliding flank 12 as represented in FIG. 4. The static friction is overcome in this first phase of movement and the core pin 6 accelerates in the axial direction together with the small plates 23 acted upon by it and the driver pin 25. This acceleration phase is followed by a second phase of movement, in which only the sliding friction of the tip 8 on the sliding flank has to be overcome. In this second phase of movement, the tip 8 passes the transitional region 13 and slides along on the second, steeper sliding surface 14. Since the cone angle $\gamma$ is slightly smaller than the apex angle $\beta$ of the second sliding flanks 14, a small gap remains between the conical surface 9 and the second sliding flank 14, but this can be compensated by slight tilting of the core pin 6, so that the core pin 6 can slide along on the second sliding flank 14 in a linearly abutting manner.

Figure 6:
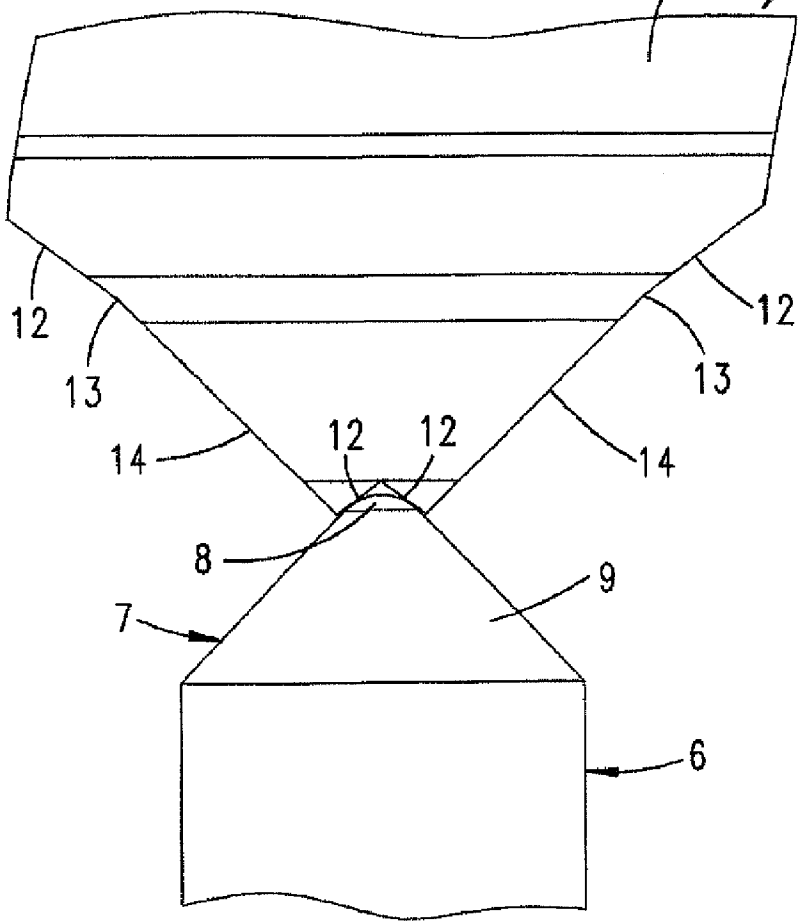
FIG. 6 shows a representation as shown in FIG. 3 with a tumbler pin lying against the first sliding surfaces of a coding recess that has only been cut in to a small depth.

FIG. 6 shows a core pin 6 lying only in a coding recess 10 that is cut in to a slight depth. Here, there is only the first sliding flank 12, which merges into the second sliding flank 14 of an adjacent coding recess while forming a sharp point.

Figure 7:
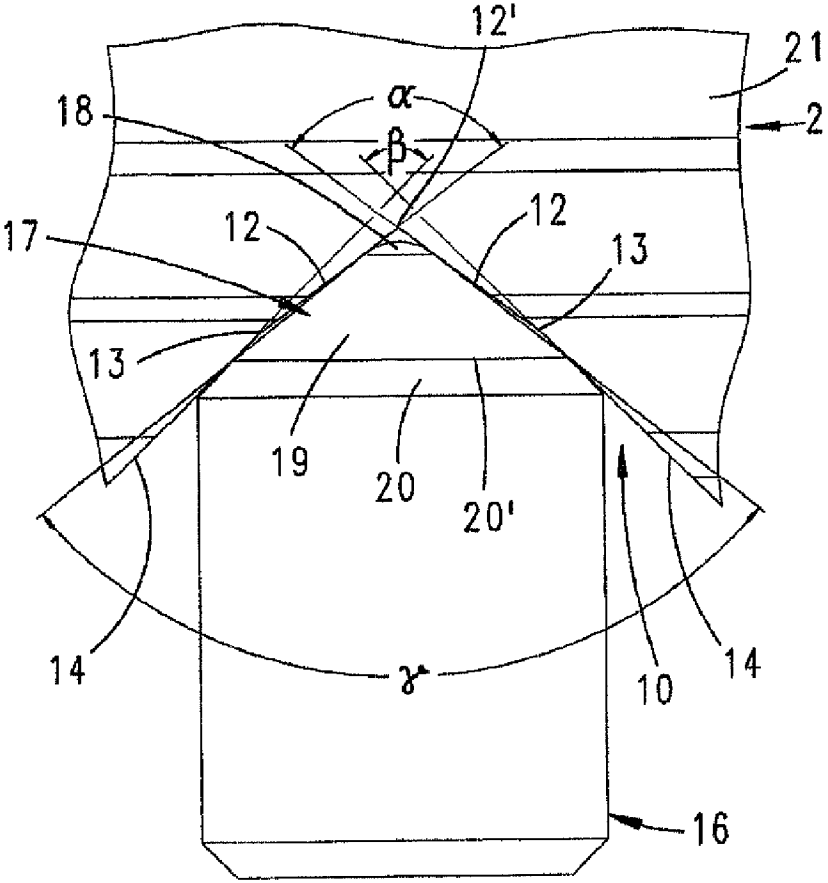
FIG. 7 shows the detail VII from FIG. 2 in an enlarged form.

FIG. 7 shows a key with a notching geometry for forming a coding recess 10 such as that which has been described above with reference to FIGS. 3 to 5. Here, a core pin 16, which has a conical surface 19 that has a cone angle $\gamma$ of 102°, lies in the coding recess 10. This first conical surface 19, which merges into the rounded tip 18 of the head 17, is followed by a second conical surface 20, which has a smaller cone angle of approximately 86°, while forming a transitional region 20'. The head 17 of this core pin lies against the second sliding flank 14 in the transitional region 20'. This core pin 16 is accelerated more than the other core pins during the withdrawal of the key.

A graduated adaptation of the core pin angles $\gamma$ to the incision angles $\alpha$, $\beta$ achieves the effect that the core pins are gently raised with different accelerations. The alternating use of core pins with continuous and graduated conical surfaces 19, 20 leads to different acceleration models. The graduated form of the incisions in the key in combination with the angles of the pins provides increased ease of operation when the key is inserted and withdrawn. The different acceleration variants provide increased protection from picking by lock bumping.

Figure 8:
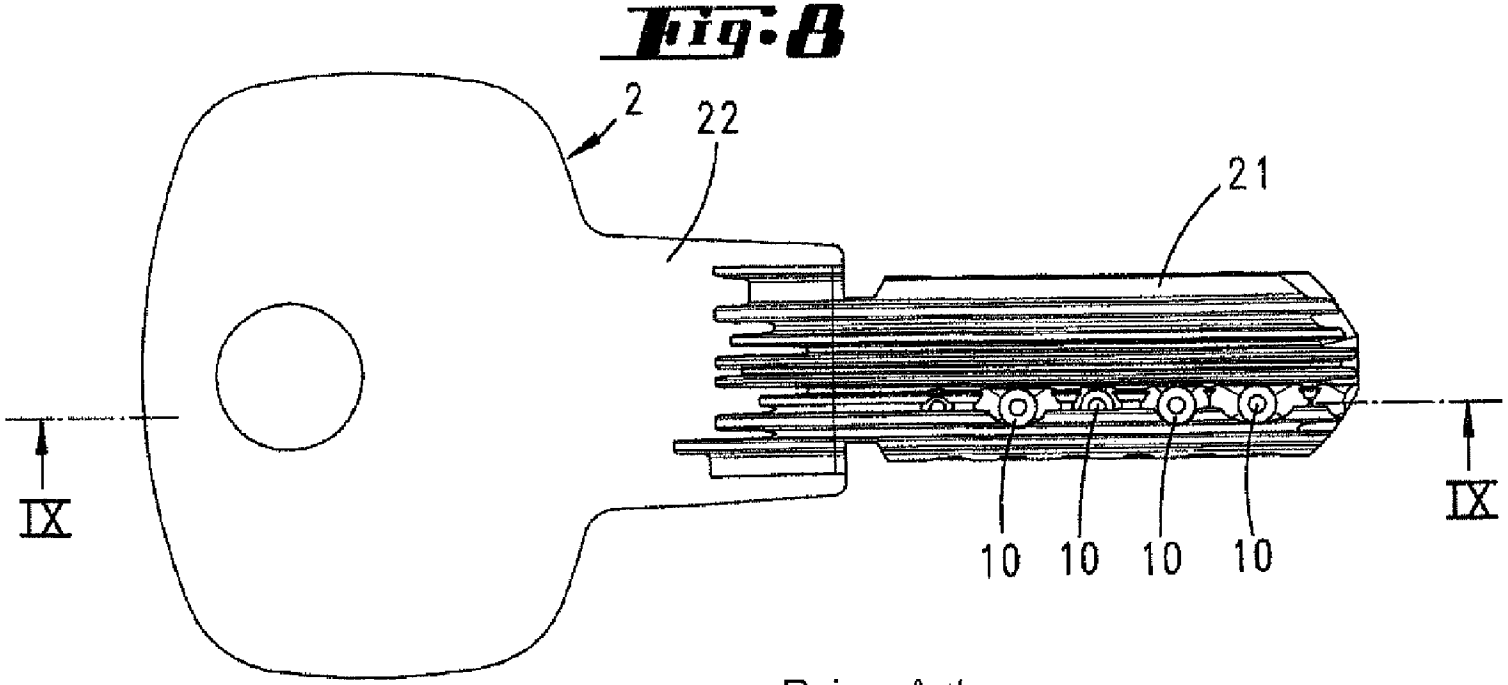
Fig. 8 Prior Art
FIG. 8 shows a flat key with recesses on the broad side according to the prior art.
Figure 9:
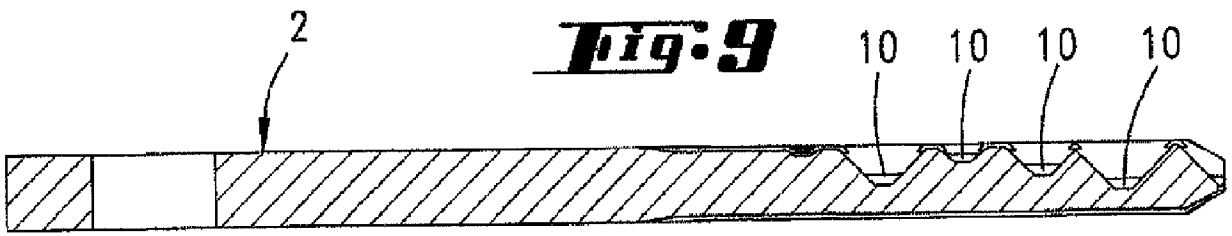
Fig. 9 Prior Art
FIG. 9 shows a cross-section along the line IX-IX in FIG. 8.

FIGS. 8 and 9 show a prior-art flat key, in which the coding recesses 10 are formed by cup-shaped milled incisions in the broad side of the key. A key of this type is described for example by DE 298 18 143 U1, which was cited at the beginning.

Figure 10:
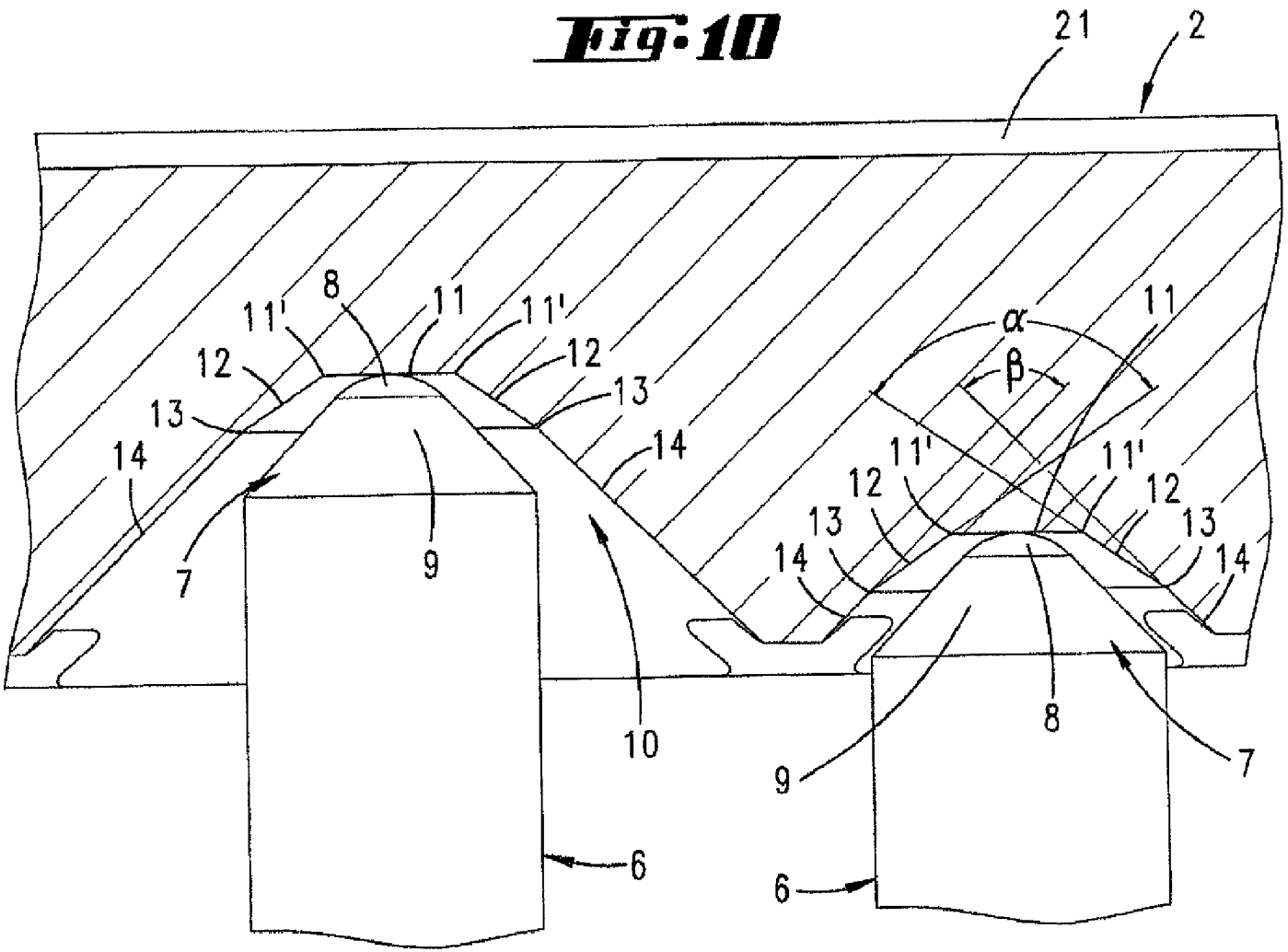
FIG. 10 shows an enlarged cross-section through two adjacent coding recesses on a key as shown in FIGS. 8 and 9 in the position of rest of the tumbler pins as further developed according to the invention.

As can be gathered from FIG. 10, the rounded tips 8 of the tumbler pins 6 are supported on supporting flanks 11. The supporting flanks 11 form the base of the coding recesses 10. The supporting flanks 11 have a circular contour and are delimited by a first wall zone running on an inner conical surface. This first wall zone forms two opposing first sliding flanks 12. In the exemplary embodiment, the apex angle $\alpha$ of the inner cone forming the first sliding flanks 12 is approximately 106°.

The first inner conical surface merges into a second inner conical surface. The second inner conical surface forms two opposing second sliding flanks 14. The inner cone angle $\beta$ of the second inner conical surface is approximately 90°, so that a transitional zone 13 is created in the form of a bent line. The transitional region 13 has with respect to the supporting flank 11 a spacing in the axial direction of the core pin 6 that is less than the spacing between the tip 8 and the base area of the cone 9 of the head 7.

The second sliding flank 14, formed by the second inner cone, merges into a broad side face of the key shank 21.

Here, too, the cone angle of the conical surface 9 is approximately 86°. The diameter here of the base area of the cone 9 is more than twice the diameter of the transitional region of the conical surface into the tip 8.

Figure 11:
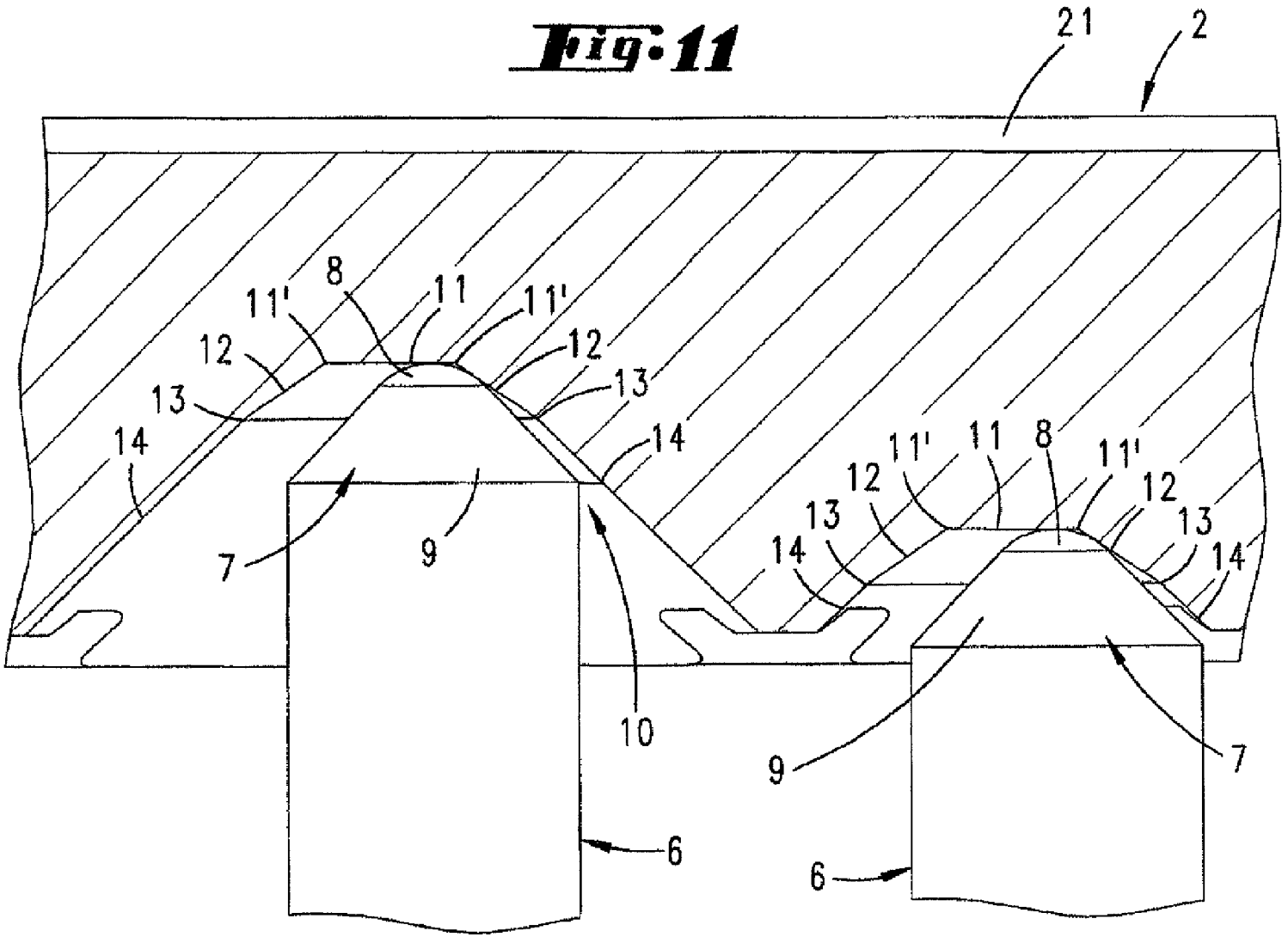
FIG. 11 shows a representation as shown in FIG. 10 before a first phase of movement with the key only having been withdrawn slightly from the key channel, to the extent that the rounded tip of the head lies against a first sliding flank.
Figure 12:
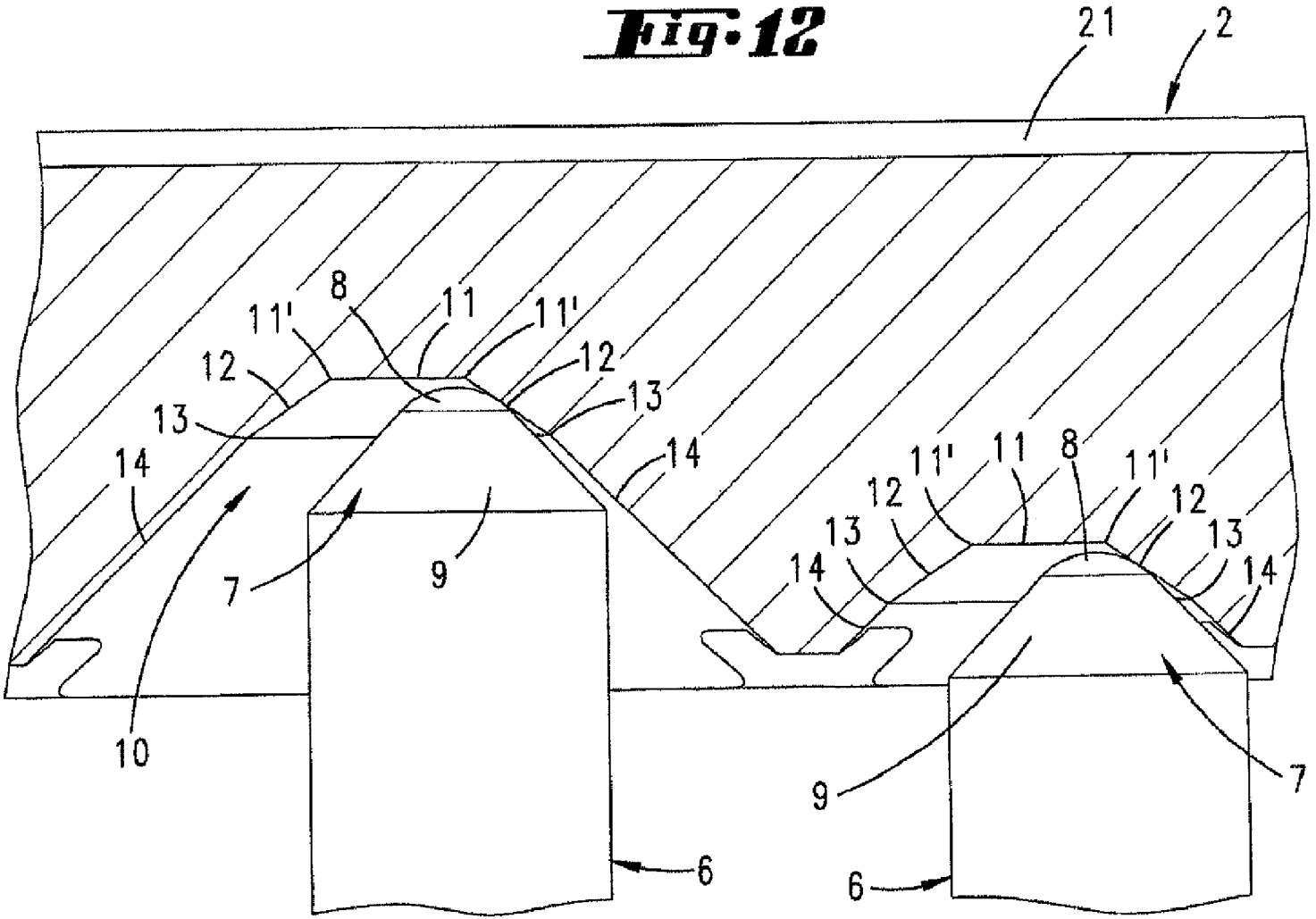
FIG. 12 shows a representation following on from FIG. 11 with the key having been withdrawn further from the key channel so that the rounded tip of the tumbler pin slides along on the first sliding flank.
Figure 13:
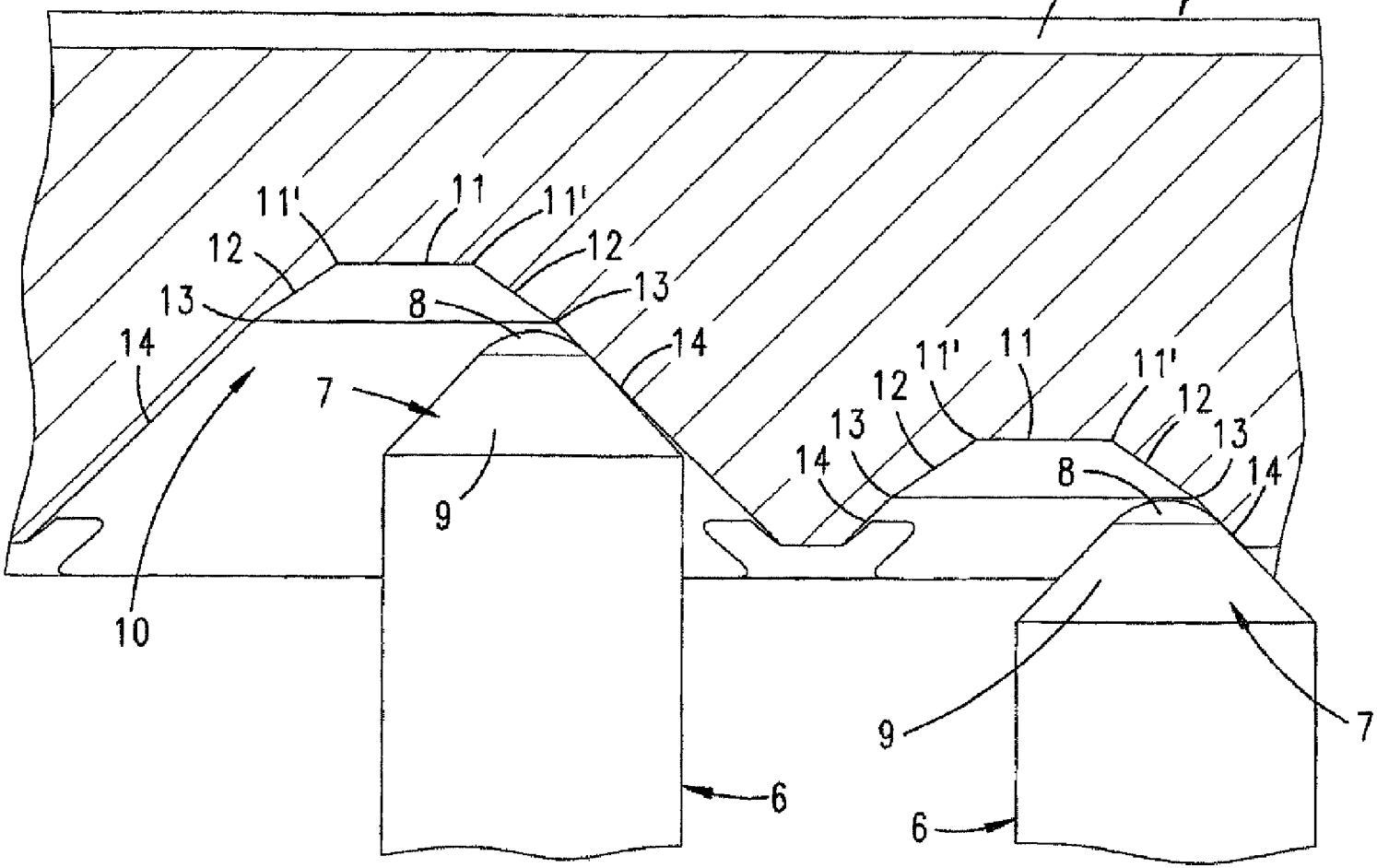
FIG. 13 shows a representation as shown in FIG. 12 with the tumbler pin sliding along on the steeper second sliding flank in a second phase of movement.

If, as shown in FIG. 11, the key 2 is withdrawn slightly from the key channel 4, the rounded tip 8 makes contact with the first sliding flank 12. The transitional region 13 is in this case covered by the conical surface 9 with a spacing in between. Further withdrawal of the key 2 from the key channel 4 leads to the state of movement represented in FIG. 12. In this phase of movement, the core pin 6 is accelerated by the rounded tip 8 sliding along on the less sloping first sliding flank 12. Following this, the rounded tip 8 passes the transitional region 13 and reaches the second phase of movement represented in FIG. 13, in which the tip 8 slides along on the second, more inclined sliding flank 14.

Figure 14:
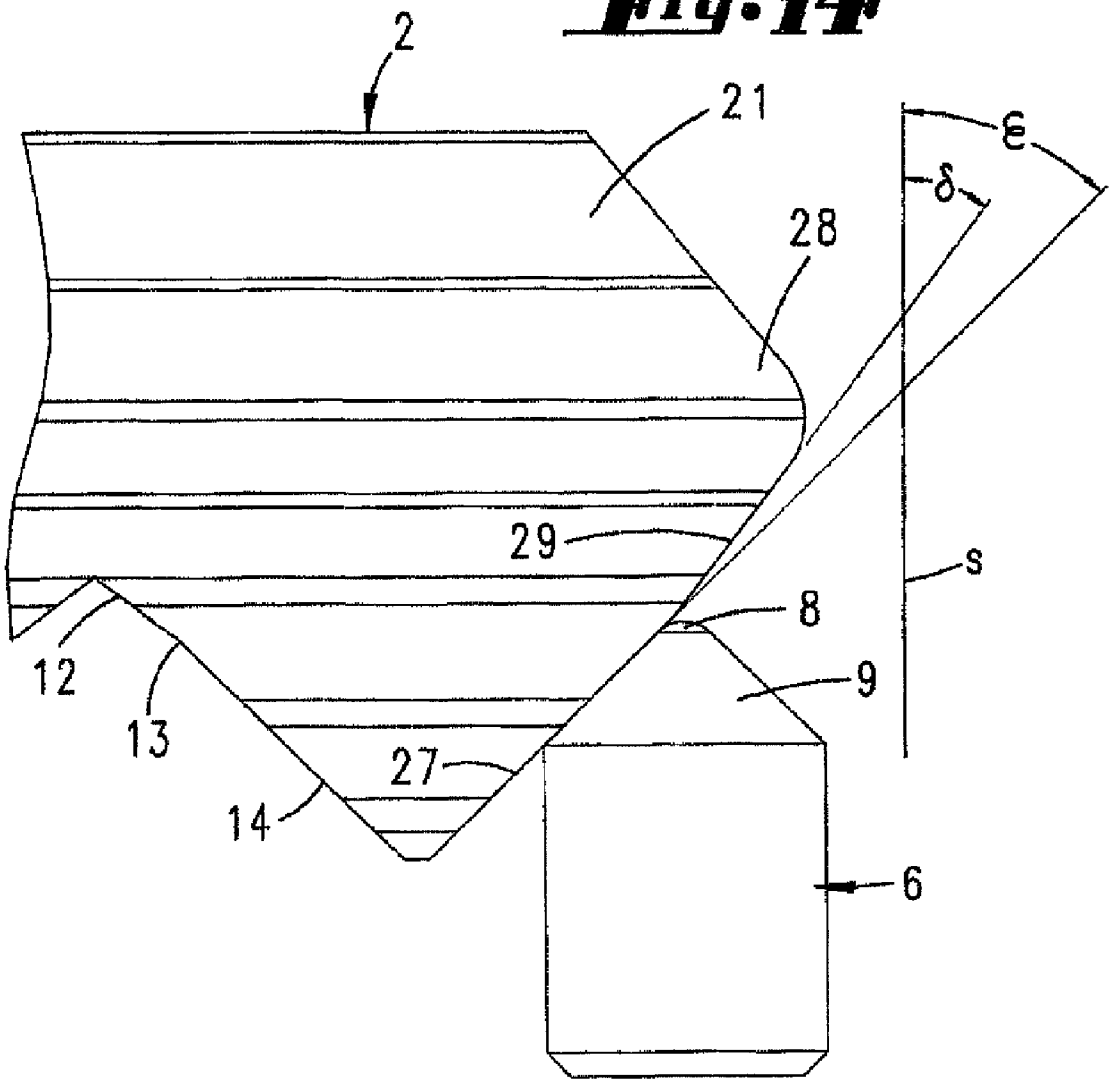
FIG. 14 shows a configuration according to the invention of a key tip.

FIG. 14 shows a tip region of a flat key configured according to the invention. A sliding slope 27, on which a conical surface 9 of a core pin 6 slides along in a linearly abutting manner when the key 2 is pushed into the key channel 4, has a slope angle $\epsilon$ with respect to the direction of movement of the core pin 6 of approximately 45°.

The sliding slope 27 is followed by a flank portion 29 of the key tip 28 that is inclined by an angle $\delta$ of approximately 37° with respect to the direction of movement S of the core pin 6. This leads to a shortened key tip, which however is nevertheless capable of coupling the key to a locking element by entering a coupling slit.

The exemplary embodiment represented in the drawings shows a cylinder 31.5 mm long with six pins. Alternatives to this are 27.5 mm long and have five pins or are longer and have seven or more pins.

All features disclosed are (in themselves) pertinent to the invention. The disclosure content of the associated/accompanying priority documents (copy of the prior patent application) is also hereby incorporated in full in the disclosure of the application, including for the purpose of incorporating features of these documents in claims of the present application. In the optionally dependent way in which they are worded, the subclaims characterize independent inventive developments of the prior art, in particular in order for divisional applications to be filed on the basis of these claims.

The invention claimed is:

1. A locking device, comprising:

a locking cylinder; and a matching key, the locking cylinder having a cylinder core with a key channel for inserting the key and pin holes, in which tumbler pins are mounted, opening out into the key channel, in which pin holes tumbler pins are mounted, the tumbler pins forming a head with a tip and a conical surface which follows on from the tip, the head engaging in a coding recess of the key and being supported there by the tip on a portion of walls of the coding recess, the walls forming a first sliding flank, on which the head of each of the tumbler pins lie in an abutting position before the axial displacement of the tumbler pins in the pin holes that is brought about by withdrawal of the key from the key channel and along which the key slides in a first phase of movement during the withdrawal of the key, and the wall forming a second sliding flank, which follows on from the first sliding flank in a transitional region, the second sliding flank slopes more steeply than the first sliding flank with respect to a direction of extent of the key and on which the head slides along in a second phase of movement during the withdrawal of the key, wherein dimensions of the conical surface following on from a rounding of the tip and the first sliding flank are made to match one another in such a way that the transitional region is covered by the conical surface in an abutting position.

2. The locking device according to claim 1, wherein the first sliding flanks and the second sliding flanks are substantially straight.

3. The locking device according to claim 1, wherein an apex angle is formed between two of the first sliding flanks and an apex angle is formed between two of the second sliding flanks, the apex angle of the first sliding flanks being substantially greater than a cone angle and the apex angle of the second sliding flanks being virtually equal to the cone angle.

4. The locking device according to claim 3, wherein the apex angle of the first sliding flanks is approximately 106°.

5. The locking device according to claim 3, wherein the apex angle of the second sliding flanks is approximately 90°.

6. The locking device according to claim 3, wherein the cone angle is slightly less than the apex angle of the second sliding flanks and is about 86°.

7. The locking device according to claim 1 wherein each coding recess is cut to a different depth, while the first sliding flanks and the second sliding flanks maintain a same configuration.

8. The locking device according to claim 1, wherein mounted in at least one further pin hole is a tumbler pin, a head of which tumbler pin has a conical surface, which follows on from the tip, the tip forming a cone angle which is greater than an apex angle formed by the second sliding flanks.

9. The locking device according to claim 8, wherein a bordering portion of the head that follows on from the conical surface lies against the second sliding flank.

10. The locking device according to claim 1, wherein the coding recess is a notch on a front side of a flat key.

11. The locking device according to claim 1, wherein the coding recess is a cup-shaped depression on a broad side of a reversible flat key.

12. The locking device according to claim 1, wherein, with the key inserted into the key channel, the tumbler pins are kept in position by simultaneous abutment of the rounding of the tip against two of the first sliding flanks intersecting at a point.

13. The locking device according to claim 1, wherein, with the key pushed into the key channel, the tumbler pins are kept in position by abutment of the rounding of the tip against a supporting flank of the coding recess.

14. A key for a locking device according to claim 1, wherein each coding recess, which form two opposing walls on which the tip of the head of the tumbler pins slide when the key is pushed into the key channel or when the key is withdrawn from the key channel, form the first sliding flanks, on which the head of the tumbler pins slide along in a first phase of movement during the withdrawal of the key, and the second sliding flanks, which follows on from the first sliding flanks in a transitional region and on which the head slides along in a second phase of movement during the withdrawal of the key and which is steeper than the first sliding flanks with respect to the direction of movement of the key, and wherein the first sliding flanks and the second sliding flanks are substantially straight.

15. The key according to claim 14, wherein an apex angle of two of the first sliding flanks of the coding recess, which oppose each other, is approximately 106°, and an apex angle of two of the second sliding flanks of the coding recess, which oppose each other, is approximately 90°.

16. The key according to one of the claim 14, wherein the key is a flat key and each coding recess is formed by notches cut on a front side.

17. The key for a locking device according to claim 14, further comprising:

a key shank having a sliding slope, sloping in relation to a direction of the key shank, at a free end of the key shank, and a key tip with a flank portion, the flank portion being adjacent to the sliding slop, wherein, with respect to the direction of the key shank, the sliding slope extends at a shallower slope than the flank portion of the key tip.

18. The locking device according to claim 1, wherein, without reducing the slope of the locking device, the second sliding flanks merge into the second sliding flanks or the first sliding flanks of the coding recess which are adjacent, or into the walls of the key shank running parallel to a direction of key insertion, substantially with sharp edges.

* * * * *